US007757981B2

(12) United States Patent
Anderson et al.

(10) Patent No.: US 7,757,981 B2
(45) Date of Patent: Jul. 20, 2010

(54) SWITCHING ASSEMBLY FOR A BATCH FEED WASTE DISPOSER

(75) Inventors: Scott W Anderson, Racine, WI (US); Srihari M Dhati, Pune (IN); Randall E Hammer, Racine, WI (US); Steven P Hanson, Racine, WI (US); Thomas R Berger, Racine, WI (US)

(73) Assignee: Emerson Electric Co., St. Louis, MO (US)

( * ) Notice: Subject to any disclaimer, the term of this patent is extended or adjusted under 35 U.S.C. 154(b) by 1153 days.

(21) Appl. No.: 11/319,355

(22) Filed: Dec. 27, 2005

(65) Prior Publication Data

US 2006/0144975 A1 Jul. 6, 2006

Related U.S. Application Data

(63) Continuation-in-part of application No. 10/389,160, filed on Mar. 14, 2003, now abandoned.

(51) Int. Cl.
*B02C 19/00* (2006.01)
*B02C 23/00* (2006.01)

(52) U.S. Cl. ..... 241/32.5; 241/36; 241/46.015; 241/46.016

(58) Field of Classification Search ..... 241/36, 241/32.5, 46.013–46.016
See application file for complete search history.

(56) References Cited

U.S. PATENT DOCUMENTS

| | | | | |
|---|---|---|---|---|
| 2,477,686 | A | 8/1949 | Coss | |
| 3,025,007 | A | 3/1962 | Wieczorek | |
| 3,374,958 | A | 3/1968 | Shive | |
| 3,409,234 | A | 11/1968 | Smith | |
| 3,425,637 | A | 2/1969 | Enright et al. | |
| 3,430,871 | A | 3/1969 | Ross | |
| 3,695,519 | A | 10/1972 | Bebinger | |
| 3,873,036 | A | 3/1975 | Smith | |
| 4,124,789 | A | 11/1978 | Preece | |
| 4,371,118 | A * | 2/1983 | Sontheimer et al. | 241/30 |
| 4,629,131 | A * | 12/1986 | Podell | 241/36 |
| 4,741,482 | A * | 5/1988 | Coggiola et al. | 241/37.5 |
| 5,249,749 | A | 10/1993 | Krebsbach | |
| 5,601,490 | A * | 2/1997 | Nakagawa et al. | 463/63 |
| 5,852,968 | A * | 12/1998 | Sundquist | 99/492 |
| 6,082,643 | A | 7/2000 | Kovacs | |
| 6,261,515 | B1 | 7/2001 | Ren et al. | |
| 6,393,635 | B2 * | 5/2002 | Rozenblatt | 4/653 |
| 6,812,594 | B2 | 11/2004 | Face et al. | |
| 2004/0178288 | A1 | 9/2004 | Berger et al. | |
| 2004/0178289 | A1 | 9/2004 | Jara-Almonte | |

(Continued)

FOREIGN PATENT DOCUMENTS

| | | | |
|---|---|---|---|
| GB | 776320 | A | 6/1957 |

(Continued)

*Primary Examiner*—Bena Miller
(74) *Attorney, Agent, or Firm*—Harness, Dickey & Pierce, P.L.C.

(57) ABSTRACT

A switching assembly for a food waste disposer includes a housing containing a switch and first and second magnets. An interlock device has third and fourth magnets. The magnets are arranged so that the switch is actuated when the first and third magnets align and the second and fourth magnets align.

14 Claims, 8 Drawing Sheets

U.S. PATENT DOCUMENTS

2006/0038047 A1 2/2006 Anderson et al.

FOREIGN PATENT DOCUMENTS

GB 1153612 A 5/1969
JP 10-099707 4/1998
JP 11010020 A1 1/1999
JP 2001029836 A1 2/2001
WO WO-2004082835 9/2004

* cited by examiner

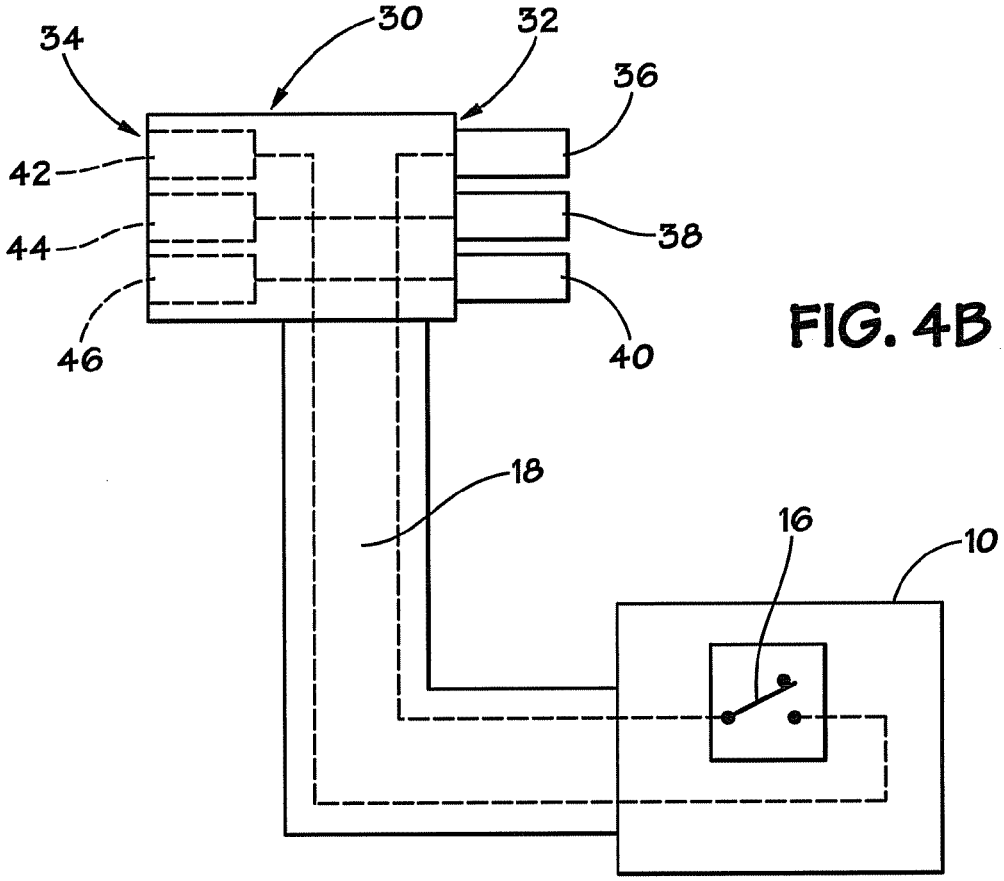
FIG. 4B
FIG. 5
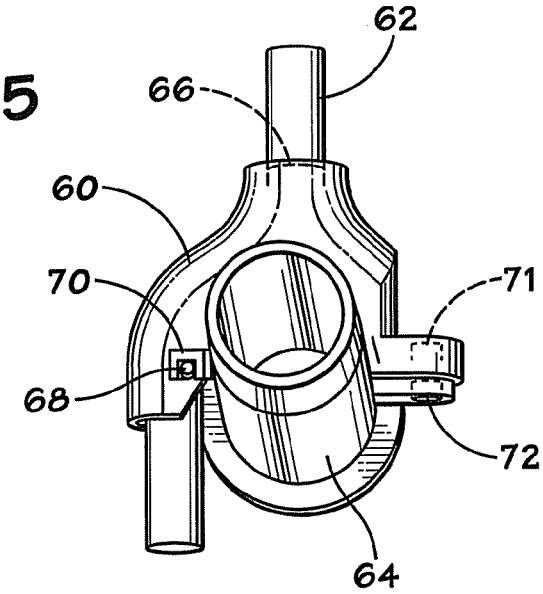

FIG. 10
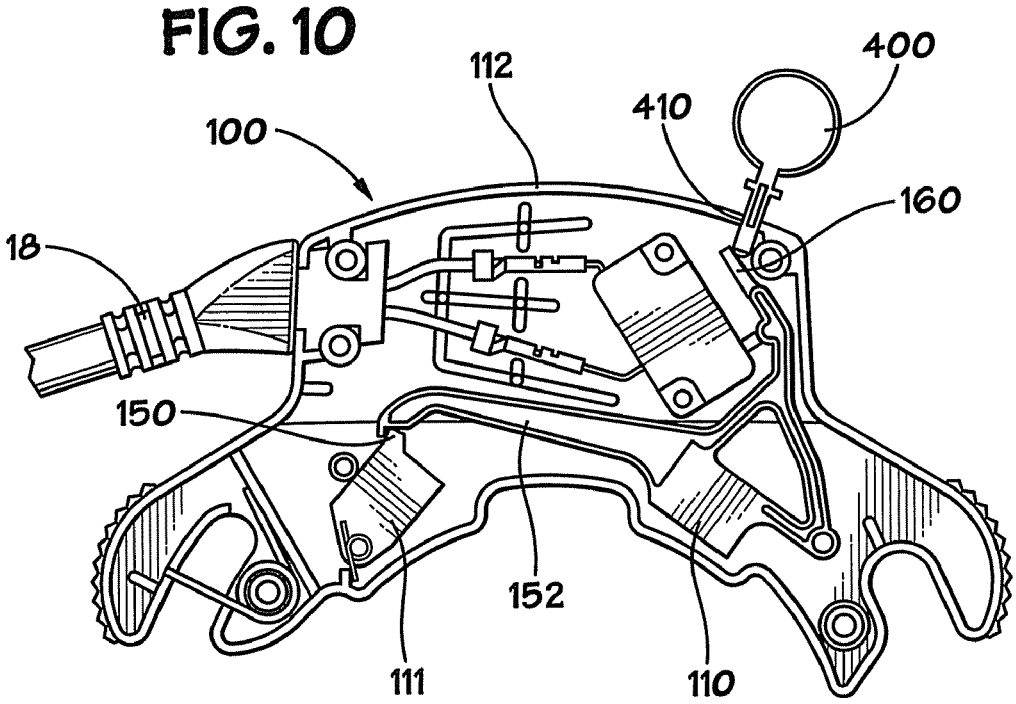
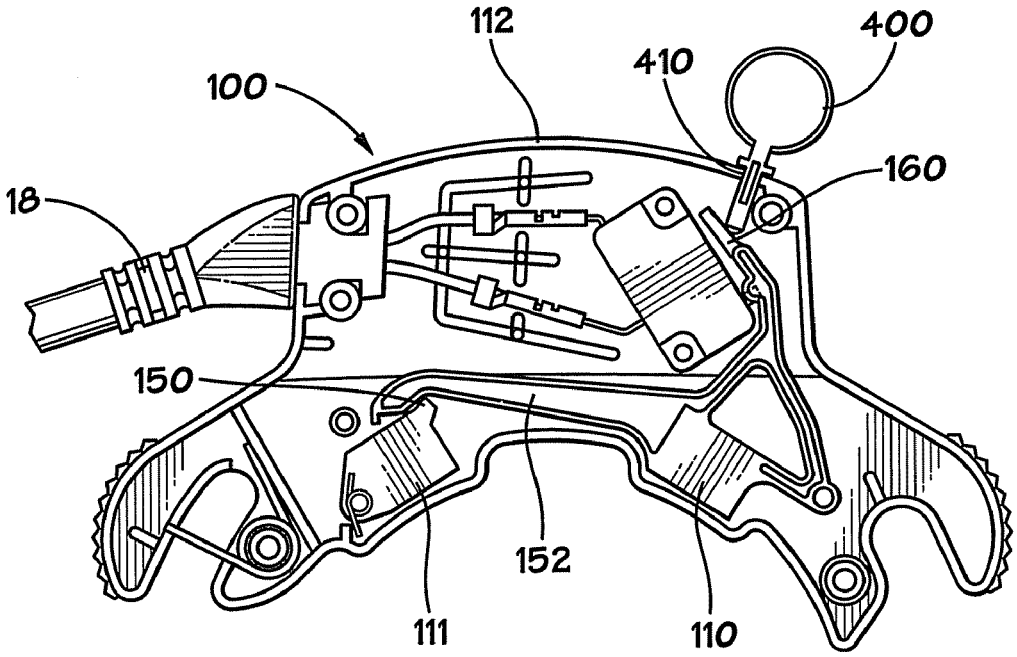
FIG. 11

SWITCHING ASSEMBLY FOR A BATCH FEED WASTE DISPOSER

CROSS-REFERENCE TO RELATED APPLICATIONS

This application claims priority to Indian Patent Application No. 1400/MUM/2005, filed on Nov. 9, 2005, and is also a continuation-in-part of U.S. patent application Ser. No. 10/389,160, filed on Mar. 14, 2003, both of which are incorporated by reference.

BACKGROUND

This disclosure is directed to food waste disposers, and more specifically to means to operate food waste disposers in a batch feed mode.

As opposed to continuous feed waste disposers, batch feed waste disposers operate by filling the disposer with waste food, then substantially blocking the drain opening prior to operating the disposer, thereby disposing of food waste in batches. A batch feed disposer uses an interlock device positioned in the drain opening to activate the disposer. The interlock device also prevents foreign objects, such as silverware, from entering the disposer during operation, but will typically allow water to flow into the disposer. Batch feed waste disposers are also used in kitchens that do not have an electrically wired switch above the sink area, in which case the interlock device acts as the switch for the batch feed waste disposer.

One common means for activating the disposer is through mechanical contact of the interlock device with a switch in the throat of the disposer. However, such mechanical means of activating the disposer have been unreliable and subject to premature failure.

Newer methods for activating a batch feed waste disposer have included non-contact approaches, such as activation of a magnetic switch for example. In this approach, the interlock device contains a magnet which, when properly aligned within the drain opening, closes a magnetic switch that activates the disposer. The interlock device must be positioned such that its magnet is in the correct vertical and radial position within the drain opening to align with the magnetic switch.

In batch feed waste disposers using magnetic switch assemblies, such as those marketed by Viking Range Corporation of Greenwood, Miss., a magnet connected to a switch, typically a snap action switch or microswitch, is used to activate the disposer. Additionally, a reed switch or Hall-Effect sensor can also be used. The assembly is typically mounted onto an exterior surface of the disposer body using a special connection assembly. What is needed is a simple magnetic switch assembly that can be easily installed on an existing food waste disposer by a homeowner without the use of tools. It is also desirable to have a magnetic switch assembly that can be easily installed onto an existing continuous feed waste disposer in order to convert the continuous feed waste disposer into a batch feed waste disposer. Moreover, it would also be desirable for a homeowner to easily convert a batch feed disposer to a continuous feed dispose.

Still further, with some existing batch feed disposers, it may be possible to inadvertently actuate the disposer with a strong magnet such as the telescoping type used to retrieve metal objects, or magnetic bracelet jewelry. A strong vibration outside the disposer could also inadvertently actuate the disposer. It is desirable to include features in the design of the switching mechanism that minimize the possibility of inadvertent actuation, and at the same time provide a reasonable level of assurance that the disposer will not be actuated by outside vibration. Inadvertent actuation of a disposer, of course, is very undesirable.

The present application addresses shortcomings associated with the prior art.

SUMMARY

In accordance with certain teachings of the present disclosure, a switching assembly for a food waste disposer includes a housing containing a switch and first and second magnets. An interlock device has third and fourth magnets. The magnets are arranged so that the switch is actuated when the first and third magnets align and the second and fourth magnets align. In certain exemplary embodiments, a lockout member is connected to the first magnet and is biased to prevent actuation of the switch device when the first and third magnets are not aligned. An activation member is connected to the second magnet, and activates the switch when the second and fourth magnets are aligned. The lockout member interacts with the activation member to lock the activation member in the off position when the activation member is in the lockout position.

In some embodiments, the third and fourth magnets are placed at specific locations in the interlock device, defining a predetermined angle between them so that the interlock device must be precisely positioned to align the magnets and actuate the disposer. For example, the third and fourth magnets may define an angle of less than 90 degrees therebetween.

To convert the disposer to a continuous feed disposer, an override device is receivable by the housing to lock the switch in an on position. The disposer can the be operated independently of the switching assembly. A cable is attached to the switch. The cable can be secured, for example, by attaching it to the disposer's dishwasher inlet tube. A stress relief device receives the cable and has a first end being pivotally connected to the tube. A fastener connects a second end of the stress relief device to the tube.

BRIEF DESCRIPTION OF THE DRAWINGS

Other objects and advantages of the invention will become apparent upon reading the following detailed description and upon reference to the drawings in which:

FIG. 4B shows a schematic diagram of the plug of FIG. 4A.

FIG. 5 shows a strain relief device in accordance with teachings of the present disclosure.

FIGS. 10 and 11 show top cross-section views of the switching assembly of FIGS. 6 and 7 with an override device.

Figure 1:
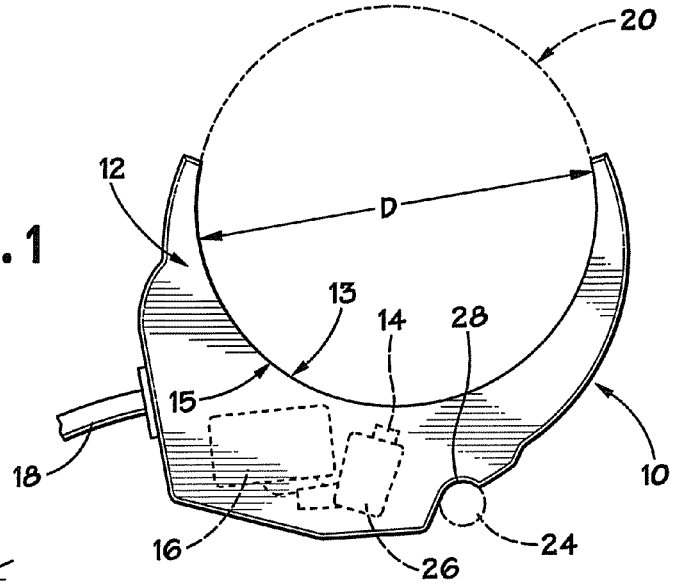
FIG. 1 shows a top view of a switching assembly in accordance with certain teachings of the present disclosure.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Referring to FIGS. 1-4, a magnetic switching assembly 10 that attaches to a sink flange 20 is shown. A discussion of sink flanges as well as standard sink mounts for food waste disposers can be found in U.S. Pat. No. 3,025,007, which is incorporated by reference herein.

FIG. 1 depicts a top view of magnetic switch assembly 10, which consists of a housing 12, a magnet 14 (contained within the housing, shown in phantom), and a switch 16 (contained within the housing, shown in phantom) operatively coupled to magnet 14. Switch 16 ultimately connects to and controls the power supply (not shown) that operates the disposer through cable 18. Housing 12 is a one-piece housing made of a plastic material or any other suitable material. The term "one-piece housing" denotes the final structure of housing 12 as used by a homeowner, and it is envisioned that housing 12 may in fact be constructed of two or more pieces.

Figure 2:
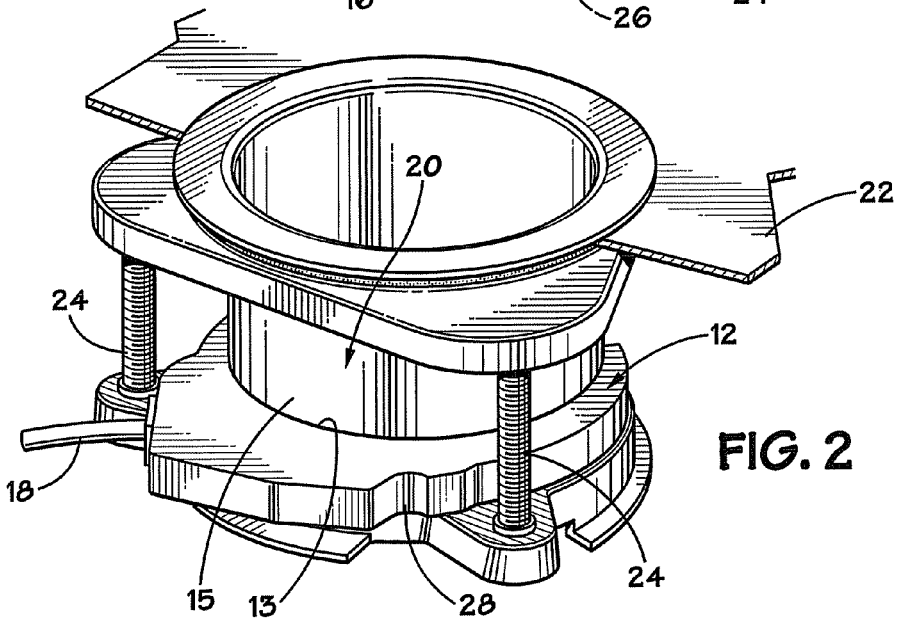
FIG. 2 shows a perspective view of a switching assembly snapped around a sink flange in accordance with certain teachings of the present disclosure.
Figure 3:
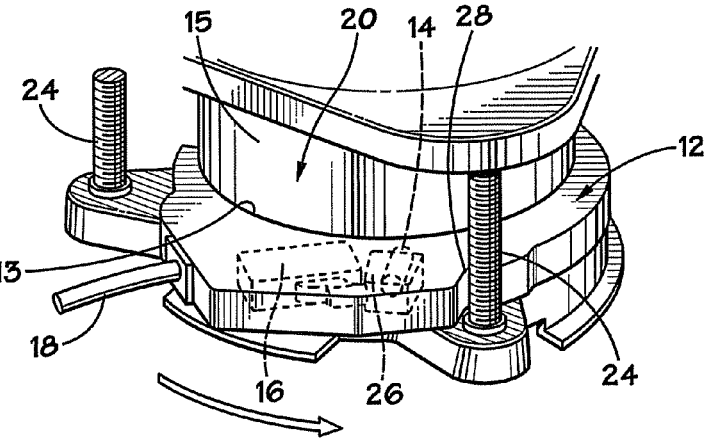
FIG. 3 shows a perspective view of the switching assembly of FIG. 2 secured by a flange screw.

It is a preferred aspect of the present disclosure that housing 12 is attached to the sink flange 20 by "snapping" housing 12 around at least a portion of the exterior periphery of sink flange 20. It is also envisioned that housing 12 may be snapped onto any exterior surface 15 of the food waste disposer circumscribing the drain opening. As best shown in FIG. 1, this snapping engagement is accomplished by providing a housing 12 that matches the approximate diameter D of sink flange 20. In this manner, a first surface 13 of housing 12 engages the external surface 15 of sink flange 20 of the disposer. As best shown in FIG. 3, this first surface 13 and the external surface 15 are generally circular in geometry. Note also that it is preferred that housing 12 encompasses greater than half of the circumference of sink flange 20 so as to promote steady engagement of housing 12 to sink flange 20 while still allowing a snap fit. As best shown in FIG. 2, housing 12 snaps around sink flange 20 and remains fittingly engaged with sink flange 20 without requiring any disassembly of sink 22, sink flange 20, or the food waste disposer (not shown). In particular, housing 12 attaches to sink flange 20 in between two of the (typically) three flange screws 24. Thus, housing 12 can be installed or removed without removing any of the flange screws 24.

Housing 12 also preferably contains a locking groove 28 that is designed to engage at least one of the flange screws. Thus, magnetic switching assembly 10 can be securely installed by first snapping housing 12 around sink flange 20 (FIG. 2), then rotating housing 12 until locking groove 28 engages a flange screw 24. Securing the magnetic switching assembly 10 in this manner reduces the likelihood of the magnetic switching assembly 10 moving during operation of the food waste disposer and provides a consistent switching location.

One of skill in the art will realize that the proper position of housing 12 on sink flange 20 (i.e. the relative vertical distance below sink 22) is dependent upon the expected location of the activating magnet when the interlock device is positioned in the drain opening. Such a person skilled in the art will be able to adjust the position of the housing accordingly.

Housing 12 is designed to hold magnet 14, switch 16, and any other coupling devices 26 necessary to operatively couple magnet 14 to switch 16. Although FIGS. 1-4 illustrate housing 12 as completely containing magnet 14 and switch 16, it is feasible that the housing only partially contains one or both of these items. Although a single switch is depicted in the figures and described herein, one of skill in the art should appreciate that a plurality of switches may be used to provide a redundant switching system (e.g. a switching mechanism in which two switches must be closed in order to activate the food waste disposer). Another functional aspect of housing 12 is the steady positioning of magnet 14 at a location proximate to the exterior surface of sink flange 20. One of skill in the art will appreciate that this may be accomplished in several ways, one of which is depicted in FIG. 1 and FIG. 3.

As noted, switch 16 is designed to enable the operation of the food waste disposer upon sensing the presence of an interlock device having a magnet within the drain opening. Switch 16 is preferably a snap action switch coupled to a magnet 14, although it is envisioned that other types of receivers may be utilize for sensing the presence of the interlock device and its magnet. One skilled in the art should appreciate that the need for a separate magnet 14 within the switching assembly 10 is dependent upon the type of switch used. In the embodiments shown in FIGS. 1-3, a snap action switch 16 is used, and is coupled to magnet 14 as a means for sensing the interlock device's magnet and thereby closing the switch. However, the use of a reed switch or a Hall-Effect sensor as the receiver would not require a separate magnet in the housing. Inside a reed switch, two ferromagnetic contacts are either attracted or repelled in the presence of a magnetic field generated by the presence of a separate magnet, in this case the magnet located within an interlock device. The core of a Hall-Effect sensor is a Hall-Effect element. When a magnet is in the vicinity of the Hall-Effect element, a current flows within the element proportional to the strength of the field. The current produced in the element creates a potential difference between the two terminals. In a Hall-Effect switch, once this potential difference goes above a certain level, the switch then closes.

A snap action switch is preferred because it can handle the high running currents of a food waste disposer, which other types of switches may not be able to handle. Examples of snap action switches commonly found today on the market include the Cherry KWSA-0001 snap action switch and the Saia-Burgess snap action switch. Other switches, such as the reed switch or the Hall-Effect switch, may need to be used in combination with a relay or triac to allow high current operation. When the disposer is not in operation, switch 16 will be in the normally open configuration, meaning that the switch contacts are in the open-circuit position (i.e. the disposer is not activated).

There are two acceptable design alternatives for closing switch 16, both of which may be used to activate the food waste disposer. First, switch 16 may be closed when magnet 14 is "attracted" by another magnet located inside the sink flange 20. Second, switch 16 may be closed when magnet 14 is "repelled" by another magnet located inside the sink flange 20. As is known, the disclosed snap action switches contains buttons which when pressed will cause the switch to be closed. It may be necessary (depending on the type of snap action switch used) to couple the movement of magnet 14 in the housing to the button on the switch 16. Accordingly, a coupling means 26, which is specially fitted to receive magnet 14 and to interface with the switch's 16 button, is designed to move as the magnet 14 moves, and accordingly to close the switch. Coupling means 26 is in one embodiment a specially formed and shaped piece of hard plastic, but could be made from several different materials and in several different configurations to effectuate proper transfer of the magnet force to the switch 16. However, depending on the orientation of the magnet and the switch, a coupling means 26 may not be necessary, so long as the magnet's force can be imparted directly to the switch. Moreover, a combined magnet/switch assembly can be used in lieu of components 14, 16, and 26, in which case the magnet on the assembly operates as the switch and directly controls the switching function.

Magnet 14 is preferably a rare earth magnet, and more preferably a magnet comprised of neodymium, and even more preferably a magnet comprised of neodymium iron boron. Rare earth magnets are preferred because of their strength, small size, reliability, and cost. Testing also reveals that rare earth magnets provide a more robust and accurate switching location, which is important for ease of use by homeowners.

Figure 4A:
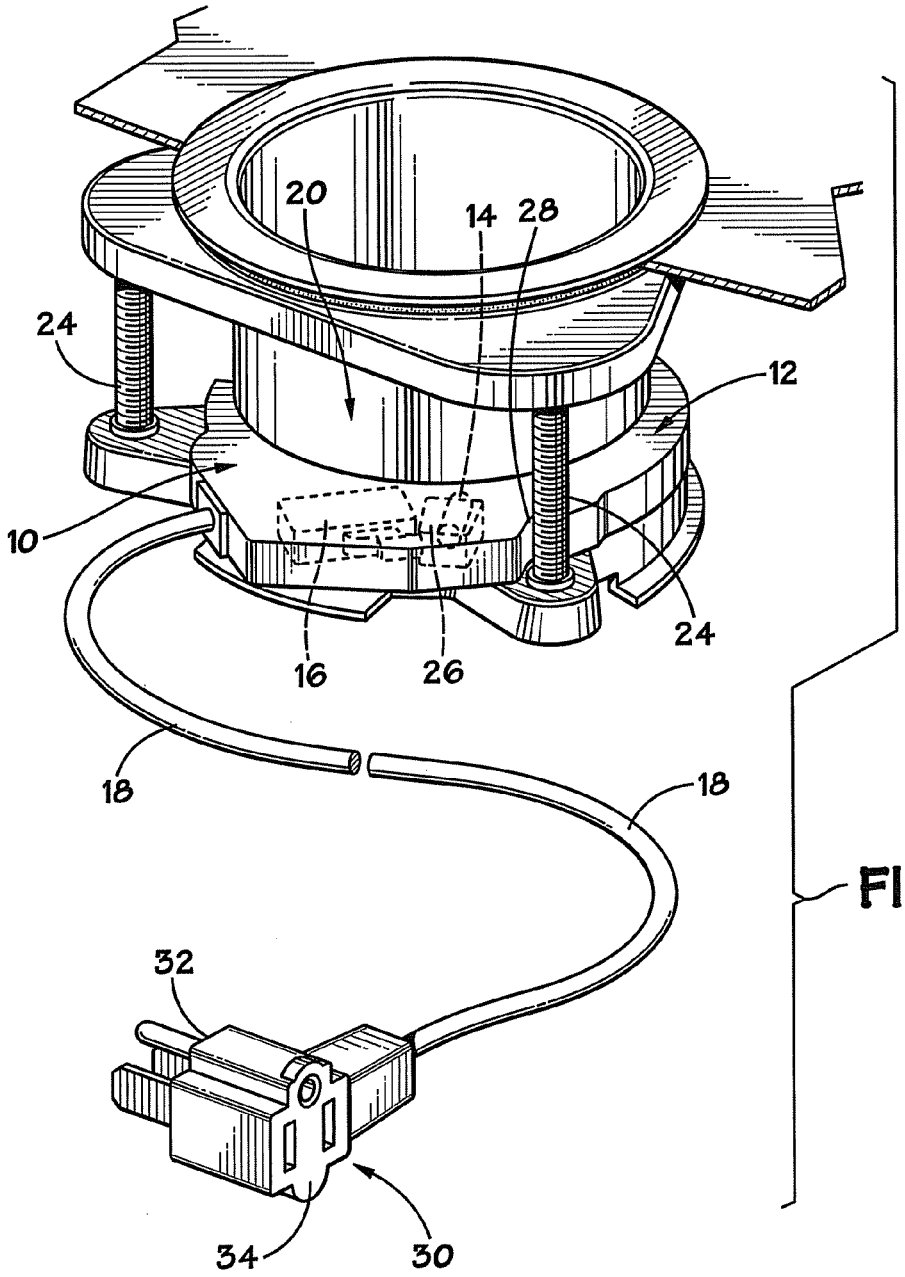
FIG. 4A shows a perspective view of the switching assembly including a plug for quick installation of the switching assembly.

FIGS. 4A and 4B show an additional feature of the present disclosure. Although cable 18 may be connected directly to the food waste disposer, cable 18, may also be connected to plug 30 which may be plugged into a standard grounded electrical outlet. Plug 30 contains a male end 32 and a female end 34. As is well known in the art, male end 32 comprises three terminals, line terminal 36, neutral terminal 38, and ground terminal 40. Female end 34 has a line receptacle 42, a neutral receptacle 44, and a ground receptacle 46 for receiving a plug from a food waste disposer (not shown). As is shown in FIG. 4B, the food waste disposer can only be activated when the circuit connecting the line terminal 36 with line terminal 42 is closed by closing switch 16 of switching assembly 10. This design is especially useful for converting a continuous feed waste disposer into a batch feed waste disposer as it does not require any wiring on the part of the homeowner.

Cables, such as the cable 18 connected to the housing 12, must be secured firmly enough to pass agency pull tests. The plastic or rubber cord insulation must not be damaged. Further, the ornamental cover of the disposer must not be subjected to any undue strain. To secure the cable or other cords associated with the disposer, a cord strain relief device is disclosed.

FIG. 5 illustrates a cord strain relief device 60 for securing a cord 62. Rather than attach the cord 62, such as the cable 18, to the housing of the disposer, the ornamental cover of the disposer is isolated from the strain of the cord because the device 60 uses the existing structure of a tube 64 associated with the disposer, such as the disposer dishwasher inlet tube, to provide an anchor for the cord 62. This allows the ornamental cover to be designed without the added expense and structure that would otherwise be required to anchor a cord.

Referring to FIG. 5, the cord 62 is slid through a hole 66 in the device 60. One side of the device is pivotally connected to the tube 64, such as by pivot pins 68 on the device 60 received by mating features 70 on the dishwasher inlet tube 64. A fastening member such as a screw is received by openings 71, 72 in the device 60 and tube 64, respectively. The screw is used to draw the two parts together, and at the same time provide both the force to crimp the cord 62 and the structural strength to provide adequate strain relief.

As noted above, the switch 16 is activated via interaction of the magnet 14 with another magnet situated inside the sink flange 20. Typically, this magnet would be part of an interlock device that is inserted into the sink flange by a user to operate the disposer. However, in some instances, it is possible for a batch feed disposer to be inadvertently actuated with a strong magnet not associated with an interlock device, such as the telescoping type used to retrieve metal objects, or magnetic bracelet jewelry.

Figure 6:
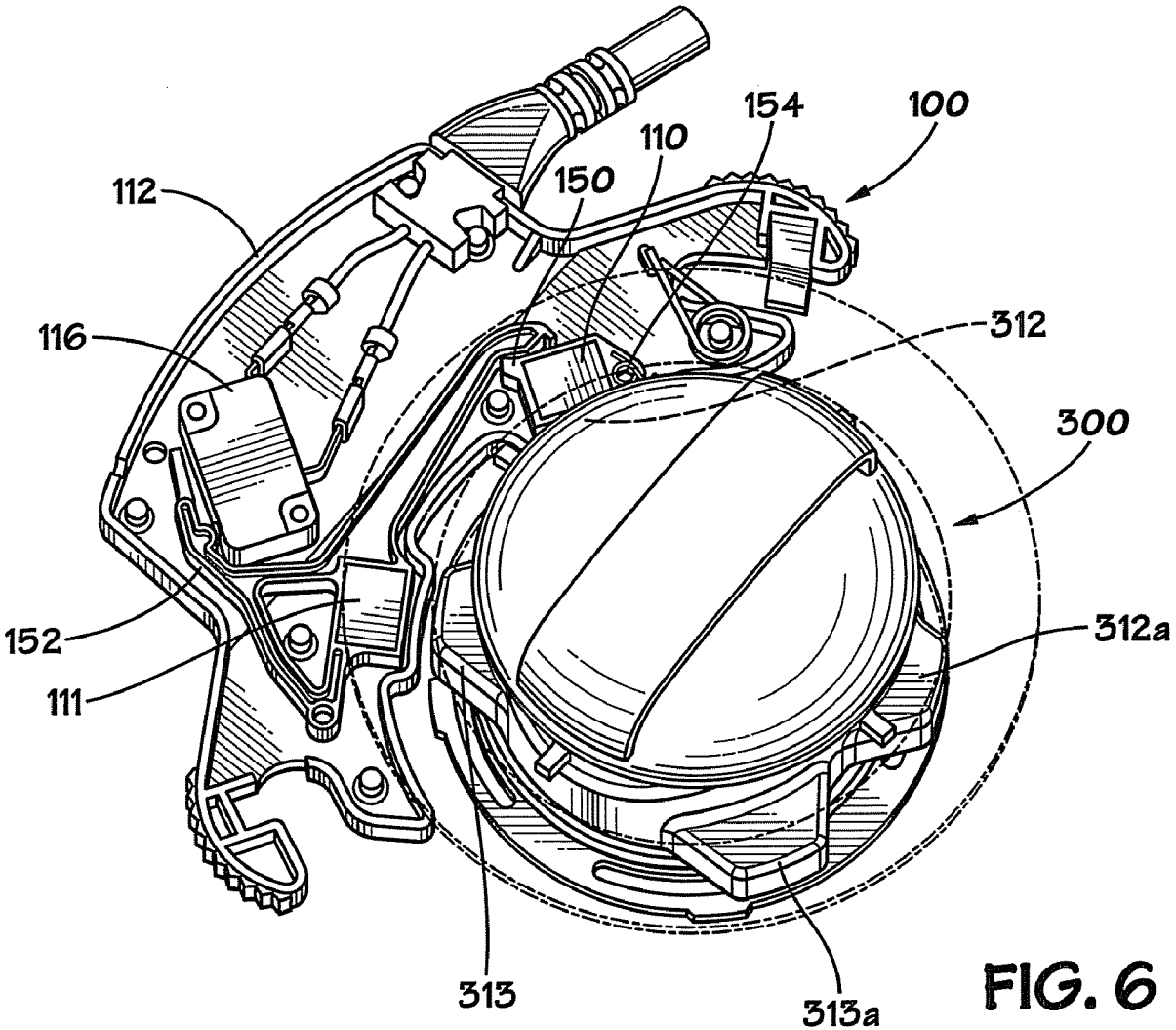
FIG. 6 shows a top view, partially in cross-section, of an embodiment of a switching assembly and interlock device with the switching assembly in the on position.
Figure 7:
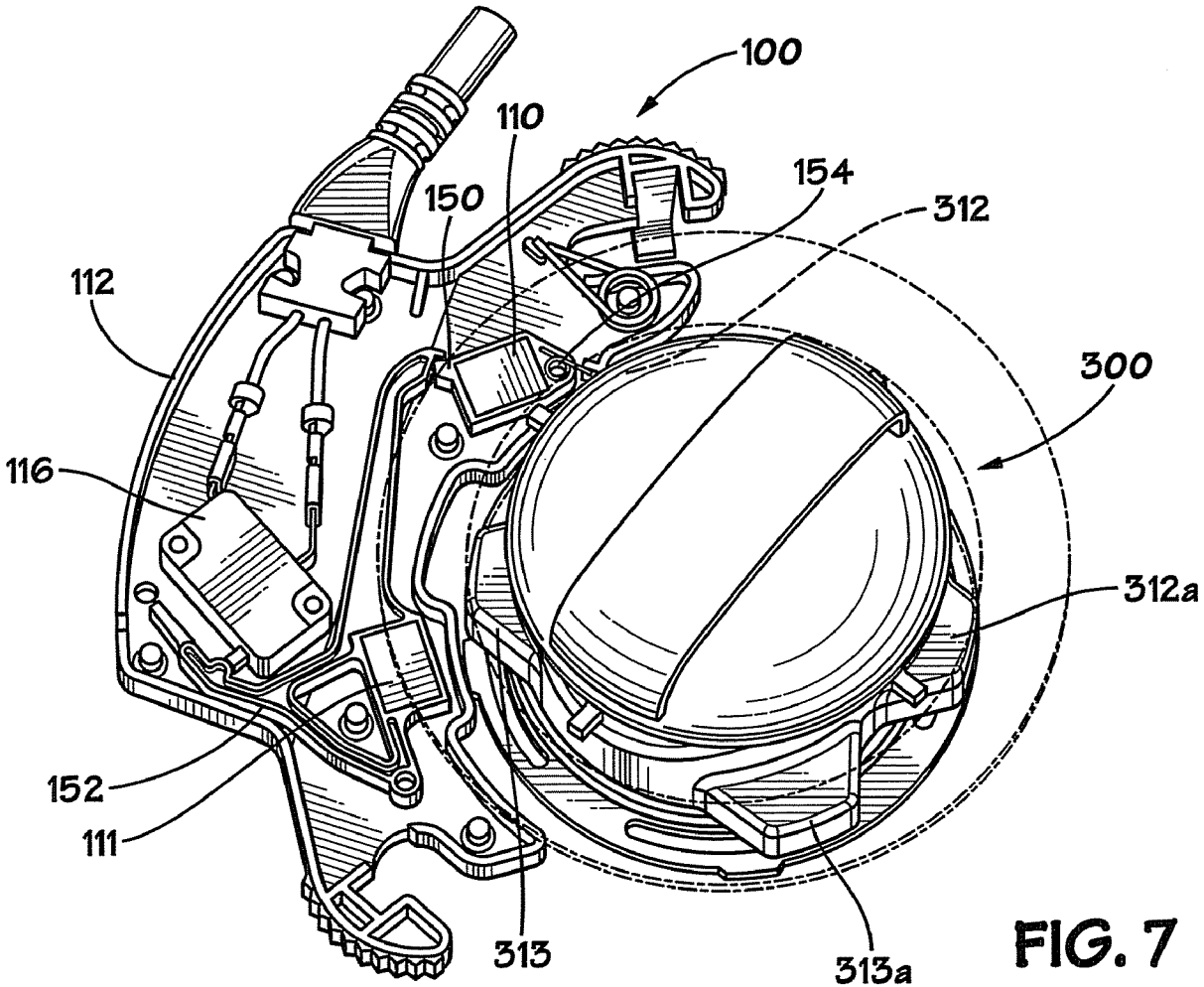
FIG. 7 shows the switching assembly and interlock device of FIG. 6 with the switching assembly in the off position.
Figure 8:
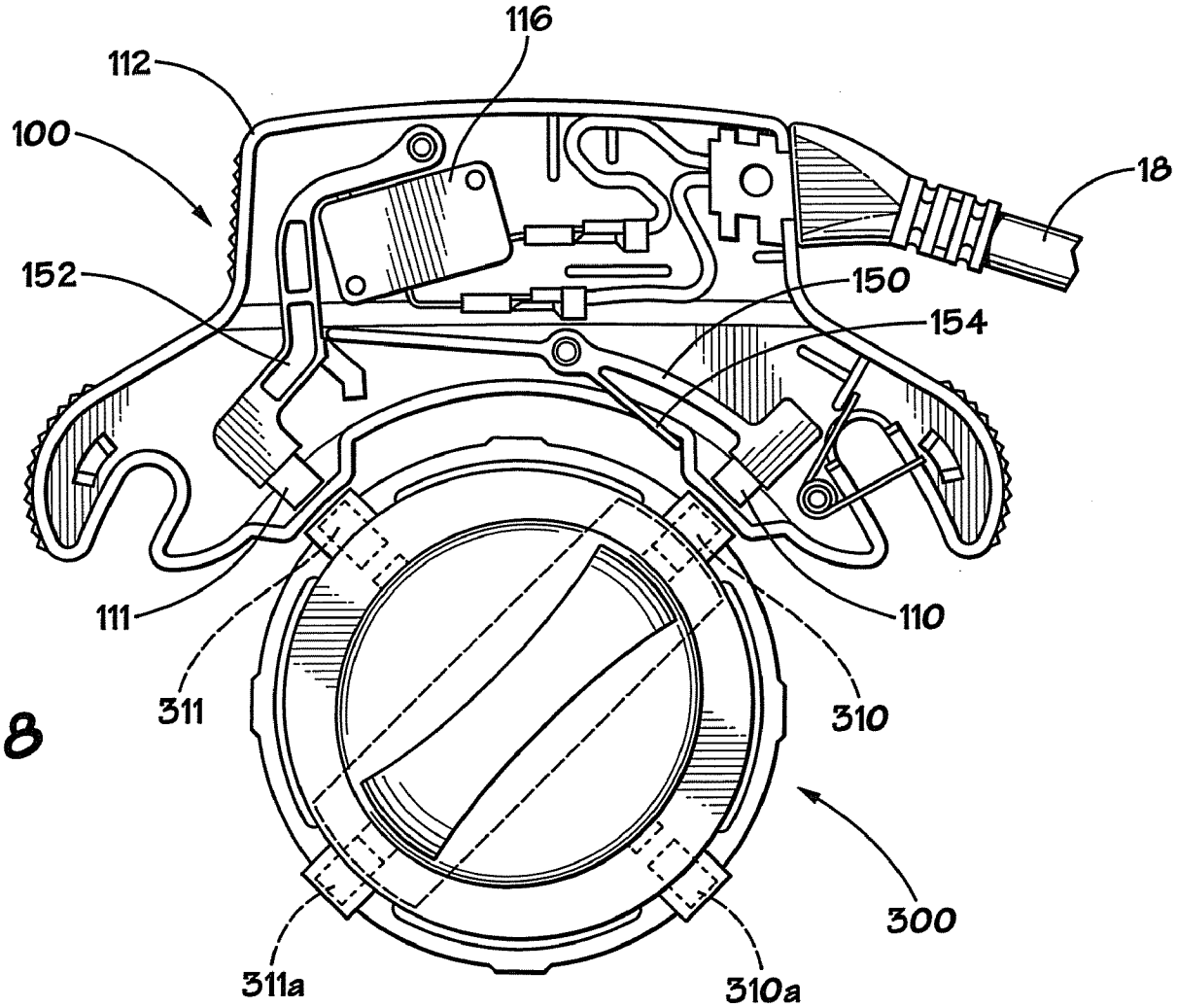
FIG. 8 shows a top view, partially in cross-section, of another embodiment of a switching assembly and interlock device with the switching assembly in the on position.

FIGS. 6 and 7 illustrate an exemplary embodiment of a switch assembly 100 and an interlock device 300 for activating the switch assembly 100 to control a food waste disposer. FIG. 6 shows the device in the on position, and FIG. 7 shows the device in the off position. FIG. 8 shows another version of the switch assembly 100 and interlock device 300.

For the interlock device 300 to actuate the switching assembly 100, two magnets 310, 311 in the interlock device 100 must be aligned with two magnets 110, 111 in the switching assembly 100. In the illustrated system, the magnets 310, 311 are received in lobes 312, 313 extending from the interlock device 300. The illustrated embodiments include a second set of magnets 310*a*,311*a* and associated lobes 312*a*, 313*a*, though these are provided as a convenience to a user and not required for operation of the system .

The interlock device 300 essentially operates as a precise magnetic "key" to unlock the switching mechanism 116 contained in the switching assembly 100. One of the magnets 310 attracts a corresponding magnet 110 attached to a lockout member 150, drawing it toward the interlock device 300 and thereby unlocking the mechanism. The second magnet 311 in the interlock 300 attracts the magnet 111 that actuates the switch 116 via an activation member or arm 152. The angle between the magnets is important. When the interlock device 300 is rotated to the right or left so that the magnets are unaligned, springs in the switching mechanism 116 turn it off. A spring 154 in the lock member 150 assists in returning the switch arm 116 to the off position. The lock member 150 moves into place, preventing the switch arm 116 from moving. As the interlock device is rotated further, the attraction between magnets serves as an "off" detent in either direction. This makes the system less likely to actuate when subjected to outside vibration. Since the angle between the magnets is less than 90 degrees, the second set of magnets 310*a*,311*a* on the other side of the interlock device 100 are not close enough to actuate the system. The second set of magnets 310*a*,311*a* are not needed for the system to function, but can be added for consumer convenience.

In alternative embodiments, polarities of the various magnets are arranged to attract or repel the locking member 150 and activation arm 152 as required to either actuate the switch 116 or lock it in an off mode. In still further embodiments, different combinations of weaker and stronger magnets are used to effect movement of the locking member 150 and activation arm 152 as desired.

Figure 9:
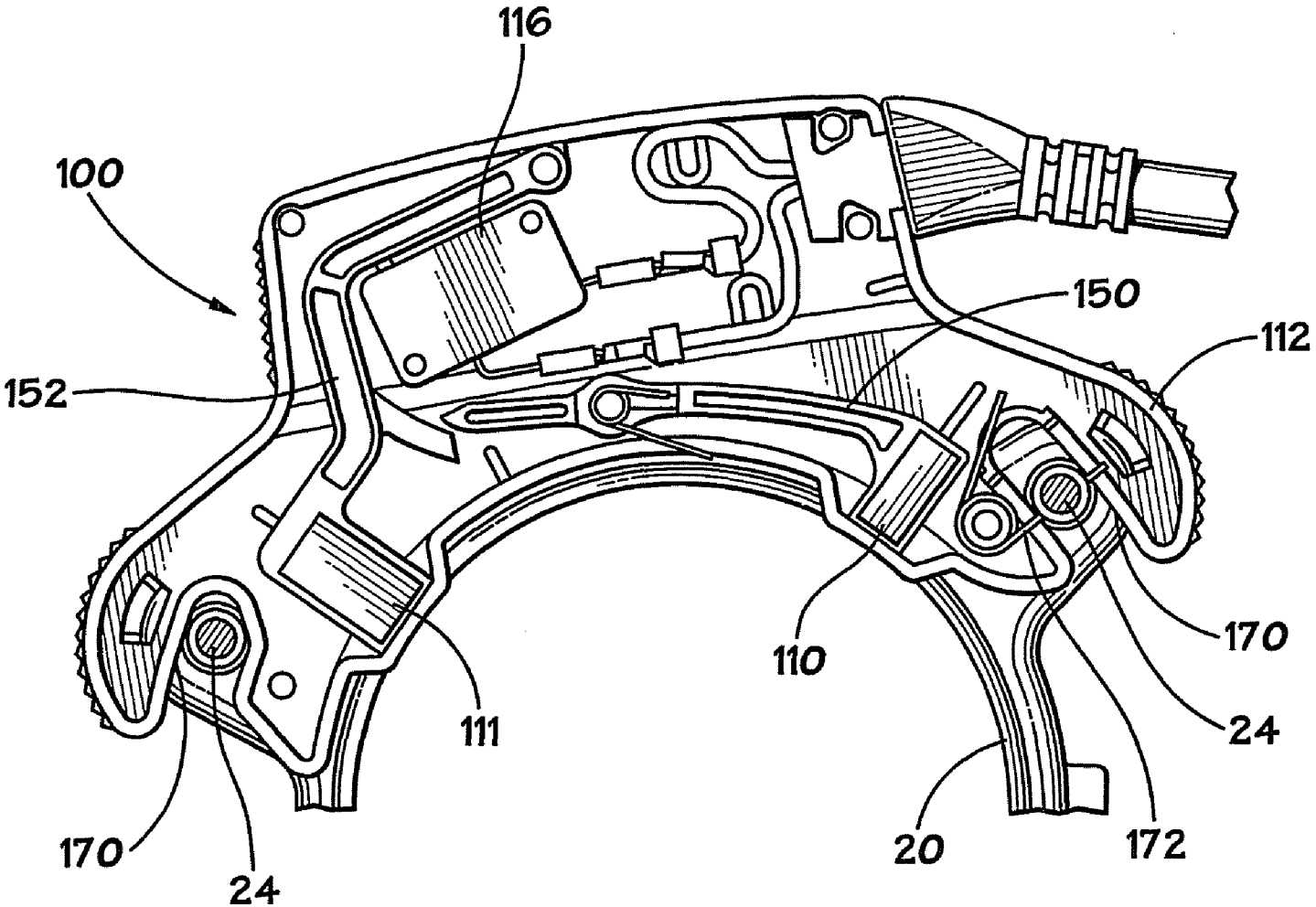
FIG. 9 shows a top cross-section view of the switching assembly of FIG. 8 attached to a sink flange of a food waste disposer.

As shown in FIG. 9, the housing 112 typically attaches to the sink flange 20 in between two of the (typically) three flange screws 24. The housing 112 defines generally wedge-shaped openings 170 that receive the flange screws 24. A securing member such as a torsion spring 172 forces the housing 112 to fit snugly against the sink flange 20.

In some instances, a consumer may prefer to actuate the disposer via a wall switch instead of using the magnetic interlock device 300. In other words, convert the disposer so that it no longer functions as a batch feed device. FIGS. 10 and 11 illustrate switch assembly 100 having an override device 400 that allows a batch feed disposer to be easily changed to a continuous feed design without any rewiring of the unit.

An override device 400 works in concert with the magnetically actuated switching assembly 100 for a batch feed disposer. As shown in FIG. 10, while the switch mechanism 116 is actuated in the on position, the override device 400 is pushed through an opening 410 in the housing 112 of the switching assembly 100 until it snaps into place as shown in FIG. 11. The tip of the override device 400 contacts an arm 160, which in turn actuates the switch 116. This locks the switching mechanism 116 in the on position and enables the consumer to use the batch feed disposer as they would a continuous feed disposer—turning the disposer on or off via a wall switch or other switch located near the disposer.

While the invention has been described with reference to specific embodiments, it is not limited to these embodiments. The invention may be modified or varied in many ways and such modifications and variations are within the scope and spirit of the invention and are included within the scope of the following claims.

What is claimed is:

1. A switching assembly for a food waste disposer, comprising:

a housing that couples to the food waste disposer containing a switch that activates the food waste disposer only when actuated and first and second magnets, the first and second magnets spaced from each other;

an interlock device having third and fourth magnets that are spaced from each other;

wherein the magnets are arranged such that the switch is only actuated when the interlock device is received in a drain opening of a sink to which the food waste disposer is attached and oriented in the drain opening so that the first and third magnets align and the second and fourth magnets align.

2. The assembly of claim 1, further comprising a lockout member connected to the first magnet, the lockout member being biased to prevent actuation of the switch when the first and third magnets are not aligned.

3. The assembly of claim 1, further comprising an activation member connected to the second magnet, the activation member activating the switch when the second and fourth magnets are aligned.

4. The assembly of claim 1, further comprising:

a lockout member connected to the first magnet, the lockout member being positionable in a lockout position and an activation position;

an activation member connected to the second magnet, the activation member being positionable in an on position where the activation member turns the switch on, and an off position;

wherein the lockout member interacts with the activation member to lock the activation member in the off position when the lockout member is in the lockout position.

5. The assembly of claim 1, wherein the third and fourth magnets define an angle of less than 90 degrees therebetween.

6. The assembly of claim 1, wherein the food waste disposer includes a sink flange coupled to a plurality of flange screws, and the housing defines a wedge-shaped opening for receiving one of the flange screws to mount the assembly to the food waste disposer.

7. The assembly of claim 6, further comprising a securing member interacting with the flange screw.

8. The assembly of claim 6, wherein the housing defines two wedge-shaped openings, each opening for receiving one of the flange screws to mount the assembly to the food waste disposer.

9. The assembly of claim 1, further comprising an override device receivable by the housing to lock the switch in an on position.

10. The assembly of claim 9, further comprising an activation member connected to the second magnet, the activation member being positionable in an on position where the activation member turns the switch on, and an off position, wherein the override device locks the activation member in the on position.

11. The assembly of claim 1, wherein the food waste disposer includes a dishwasher inlet tube, the assembly further comprising:

a cable coupled to the switch and extending from the housing;

a stress relief device receiving the cable, the stress relief device having a first end being pivotally connected to the tube; and a fastener connecting a second end of the stress relief device to the tube.

12. The assembly of claim 11, wherein the first end of the stress relief device includes a pivot pin received by a corresponding opening in the tube.

13. The assembly of claim 1, further comprising means for locking the switch in an on position.

14. The assembly of claim 1, further comprising:

a cable coupled to the switch; and means for securing the cable to the food waste disposer.

* * * * *

UNITED STATES PATENT AND TRADEMARK OFFICE

CERTIFICATE OF CORRECTION

PATENT NO. : 7,757,981 B2
APPLICATION NO. : 11/319355
DATED : July 20, 2010
INVENTOR(S) : Scott W. Anderson et al.

It is certified that error appears in the above-identified patent and that said Letters Patent is hereby corrected as shown below:

Column 4,
Line 40, "utilize" should be --utilized--

Signed and Sealed this

Twenty-first Day of December, 2010

David J. Kappos

David J. Kappos
*Director of the United States Patent and Trademark Office*